US005181711A

United States Patent [19]

Spoorenberg

[11] Patent Number: 5,181,711

[45] Date of Patent: Jan. 26, 1993

[54] DEVICE FOR DISCHARGING SHEETS FROM THE BOTTOM OF A STACK

[75] Inventor: Christophorus L. Spoorenberg, Nuenen, Netherlands

[73] Assignee: Oce-Nederland, B.V., Venlo, Netherlands

[21] Appl. No.: 766,138

[22] Filed: Sep. 27, 1991

[30] Foreign Application Priority Data

Sep. 28, 1990 [NL] Netherlands ..... 9002121

[51] Int. Cl.[5] ..... B65H 3/14; B65H 3/46

[52] U.S. Cl. ..... 271/98; 271/99; 271/105; 271/171

[58] Field of Search ..... 271/98, 99, 104, 105, 271/94, 171

[56] References Cited

U.S. PATENT DOCUMENTS

| | | | |
|---|---|---|---|
| 2,812,178 | 11/1957 | Hagren et al. . | |
| 3,099,442 | 7/1963 | Wendricks et al. . | |
| 3,163,414 | 12/1964 | Lingenbrink | 271/99 |
| 3,583,696 | 6/1971 | Runzi | 271/110 |
| 4,506,875 | 3/1985 | Capdebosco et al. | 271/99 |
| 5,050,853 | 9/1991 | LaVos et al. | 271/104 |

FOREIGN PATENT DOCUMENTS

| | | | |
|---|---|---|---|
| 104879 | 4/1984 | European Pat. Off. | 271/99 |
| 1460465 | 11/1966 | France . | |
| 2219665 | 9/1974 | France . | |
| 188242 | 11/1983 | Japan | 271/99 |
| 295216 | 7/1963 | Sweden . | |

*Primary Examiner*—Robert P. Olszewski
*Assistant Examiner*—Steven M. Reiss
*Attorney, Agent, or Firm*—Birch, Stewart, Kolasch & Birch

[57] ABSTRACT

A holder for receiving sheets and discharging sheets therefrom one-by-one from the bottom of a stack of sheets is provided including a carrier having a rear portion, an intermediate portion and a front portion, providing a carrying surface for the sheets, the carrier being bent at the intermediate portion thereof, transverse to the direction of conveyance of the sheets, so as to create a deepened section between the rear portion and the front portion. Lateral supports extend from lateral edges of the carrier, with at least one elevated part provided in the deepened section at the intermediate portion extending transverse to the direction of conveyance on the carrying surface of the carrier. At least one aperture is provided in the carrier near at least one of the lateral supports in the vicinity of the deepened section of the carrier and the elevated part, beneath at least one edge area at a side of the stack of sheets accommodated in the holder, such that a partial vacuum can be produced, by way of the aperture using a vacuum device. A device for introducing and blowing air across the deepened section of the carrier against the side of the stack of sheets creates an air layer between the bottom sheet in the stack of sheets and the remaining sheets in the stack. A transport mechanism discharges the bottom sheet.

15 Claims, 4 Drawing Sheets

DEVICE FOR DISCHARGING SHEETS FROM THE BOTTOM OF A STACK

BACKGROUND OF THE INVENTION

1. Field of the Invention

This invention relates to a paper sheet receiving and discharging device and more specifically to a device for discharging sheets of paper or the like one-by-one from the bottom of a stack of sheets.

2. Related Art

Heretofore it has been known to blow air towards the side of a stack of sheets in the vicinity of a deepened part of a sheet carrier, while at the same time the bottom sheet of the stack is sucked against the carrier, with the result that an air layer forms between the sheet and the stack thereabove, lifting the stack from the bottom sheet, thus reducing the friction between the bottom sheet and the rest of the stack allowing the bottom sheet to be conveyed. Although in such a device there is generally pretty good separation between the bottom sheet and the rest of the stack, it has been found in practice that disturbances in separation and transport may occur when stacks of sheets are used with different stack weights and stack heights, when use is made of sheets with different rigidities, or when the sheets used are curled or have deformations due, for example, to stapling or perforating.

SUMMARY OF THE INVENTION

Therefore, it is an object of the present invention to provide a device for receiving, separating and discharging stacked sheets which will overcome the above noted disadvantages.

It is a further object of the present invention to provide a sheet stacking device which allows for the reliable discharge of sheets from a holder one by one from the bottom of a stack of sheets.

It is still a further object of the present invention to provide a device for reliably discharging sheets of paper one by one from the bottom of a stack of sheets regardless of the weight or height of the stack of sheets or the rigidity of the sheets.

The foregoing objects and others are accomplished in accordance with the present invention, generally speaking, by providing a holder for stacking sheets of paper thereon. The holder comprises a carrier having lateral supports, the carrier having a downwardly slanted rear portion bent transversely thereto so as to create a deepened section on the carrying side or surface of the carrier substantially intermediate to a front portion of the carrier. In the deepened section of the carrier extending transversely of the direction of conveyance of the sheets of paper is provided at least one elevated part on the carrying surface of the carrier demarcating the intermediate portion of the carrier. In the vicinity of the deepened section near the lateral supports there is provided in the carrier at least one aperture beneath at least one edge area at the side of a stack of sheets accommodated in the holder considered with respect to the direction of conveyance of the sheets, by which aperture a partial vacuum can be produced by way of a vacuum means and in the lateral wall a means juxtapositioned to the elevated part of the carrier for introducing and blowing air across the deepened section of the carrier against at least one side of the stack of sheets in order to create an air layer at least between the bottom sheet in the stack and the remaining sheets in the stack thereabove, so as to separate the bottom sheet therefrom. A transport means is provided for discharging the separated bottom sheet.

It has been determined according to the present invention that by providing a paper holder having an elevated part of the carrier at a deepened part thereof, extending transversely of the direction of conveyance, in combination with at least one aperture beneath at least one lateral edge of a side of a stack of sheets on the carrier and a means for introducing air so as to create an air layer between at least the bottom sheet in a stack of sheets and the remaining sheets, the reliability regarding the conveyance and discharge of the sheets in the stack is greatly improved, particularly in the case of different stack weights, different stack heights and differences in sheet rigidities. When used in the course of the present application, the term intermediate is intended to mean lying or occurring between two extremes but not necessarily in the middle thereof.

In a first embodiment of a device according to the present invention the elevated part comprises a rib extending over the carrier transversely of the direction of sheet conveyance. An embodiment of this kind is simple to produce and inexpensive.

Another embodiment of the invention is characterized in that the means for blowing air against one side of the stacked sheets comprises blowing apertures on either side of the elevated part considered in the direction of the conveyance of the sheets. As a result, when the air is blown the forces exerted by the air on the bottom of the stack are more uniformly distributed, thus further improving the separation of the bottom sheet from the remainder of the stack.

In order to still further improve the separation of the bottom sheet from the stack thereabove, the blowing apertures are disposed on either side of the elevated part so as to diverge with respect to one another. When air is blown in over the carrier, an air layer forms at the front and rear surfaces between the bottom sheet and the stack thereabove, so that contact between the front and rear edges of the bottom sheet and the stack is reduced, thus preventing sheets lying above the bottom sheet from being simultaneously entrained during the discharge of the bottom sheet.

In yet another embodiment, the blowing apertures are provided with means whereby the air blown towards the stack can be expanded in a direction perpendicular to the carrier. In this way the speed of separation of the bottom sheet from the stack is improved.

Devices are also known in which air is blown into the stack of sheets at the front of the stack as considered in the direction of conveyance of the sheets. As compared with these devices, the device according to the present invention has the advantage that it can be made suitable for processing different formats simply by moving one or both lateral supports within certain limits.

When the device according to the present invention is used on an electrophotographic copying machine for discharging a set of documents sheet-by-sheet repeatedly to the exposure station of the machine, whereafter the sheets are reproduced and then deposited again into the holder, this device additionally has the advantage that the redeposition of the sheets on the holder does not take place against an air flow so that the sheets come to rest on the stack once again rapidly and well positioned.

BRIEF DESCRIPTION OF THE DRAWINGS

Other features and advantages of the invention will be apparent from the following description with reference to the accompanying drawings wherein.

DETAILED DISCUSSION OF THE INVENTION

Figure 1:
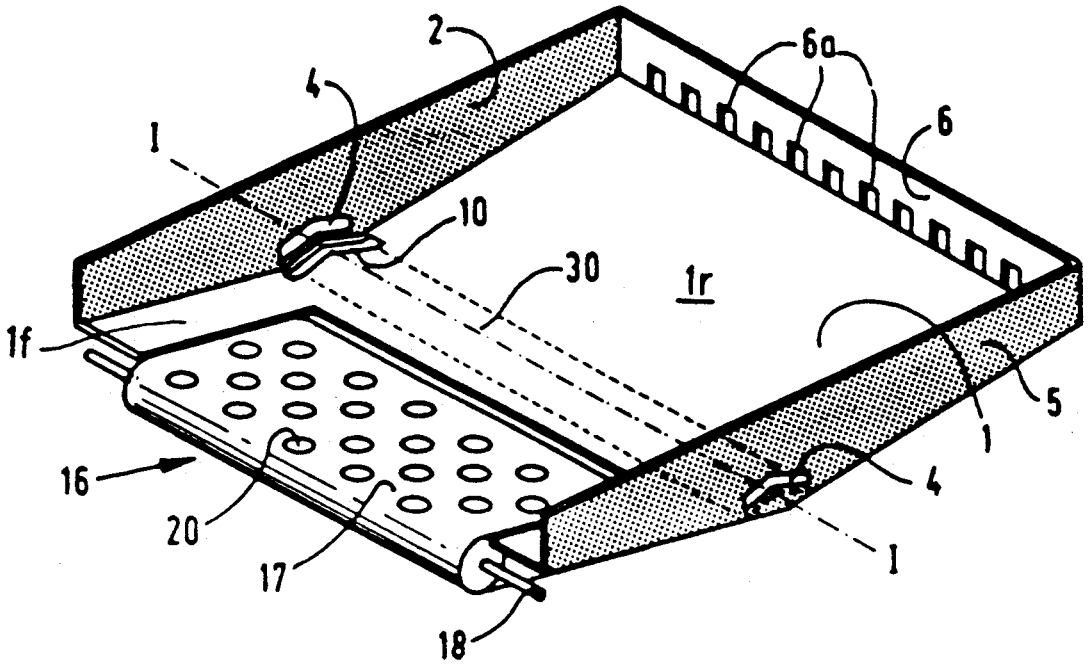
FIG. 1 is a diagram showing one embodiment of the device according to the present invention.

The device shown in FIG. 1 represents a holder for a stack of sheets, such as paper, comprising a carrier 1 having a downwardly slanted rear portion 1*r* extending in a direction of conveyance of the sheets and bent transversely, terminating at an intermediate portion and continuing as a front portion 1*f*. Lateral supports in the form of side walls 2,5 are provided to each of which is secured an air supply duct (not shown) which can be connected to one or more air supply sources and which terminate in a blowing aperture 4 in the vicinity of a deepened part or section of the holder created by the slanted shape of the rear portion, through which aperture air is blown towards a side of the stack of sheets perpendicularly to the direction of conveyance of the sheets and parallel to the width of the carrier.

The deepened part of the carrier 1 is provided with an elevated part 30 at the intermediate portion in the form of a projection or rib extending between the side walls 2,5 transversely of the direction of conveyance. The holder is also provided with a rear wall 6 formed with apertures 6*a*. The apertures 6*a* in the rear wall 6 are used to discharge air blown into the stack. However, it is also possible to use a closed rear wall. This is in fact advantageous when thick stacks of very curled sheets are used. When use is made of a rear wall with apertures 6*a* in processing thick stacks of very curled sheets, the air blown from the side into the stack disappears quickly and practically no layer of air, if any, will form between the sheets. Therefore, a closed rear wall shuts off the stack in the case of the very curled sheets so that the blown air is retained and an air layer if formed.

Figure 1A:
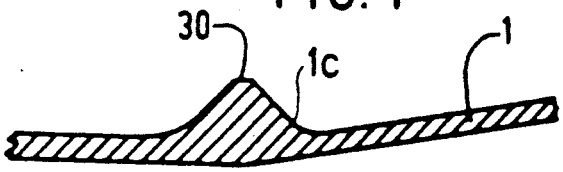
FIG. 1*a* is a diagrammatic side elevation of part of the carrier of the device shown in FIG. 1 at the elevated part.

As shown in the side elevation in FIG. 1*a*, the rib 30 has a triangular cross-section in the direction of conveyance. The corners 1*c* of the triangle are generally rounded in order to facilitate the transport of, for example, a paper sheet over the rib. The height of the rib is about 2 mm. Other heights are also possible in practice.

In the vicinity of the blowing apertures 4 the carrier 1 is further formed with apertures 10 within or in the vicinity of the elevated part, such that a partial vacuum can be created whereby the bottom sheet of the stack can be sucked towards the carrier 1 at the blowing apertures 4. These apertures 10 are generally in the form of slots extending near the areas where air is effectively blown into the stack and are situated in the vicinity of the side edges of the sheets, thus preventing the air blown into the stack via the apertures 4 from being blown between the bottom sheet and the carrier 1. To create the partial vacuum the apertures 10 are connected to vacuum means (not shown), such as a vacuum pump. The front portion of the carrier 1 has a recess area formed therein into which is inserted a transport means 16 comprising an endless belt 17.

Figure 2:
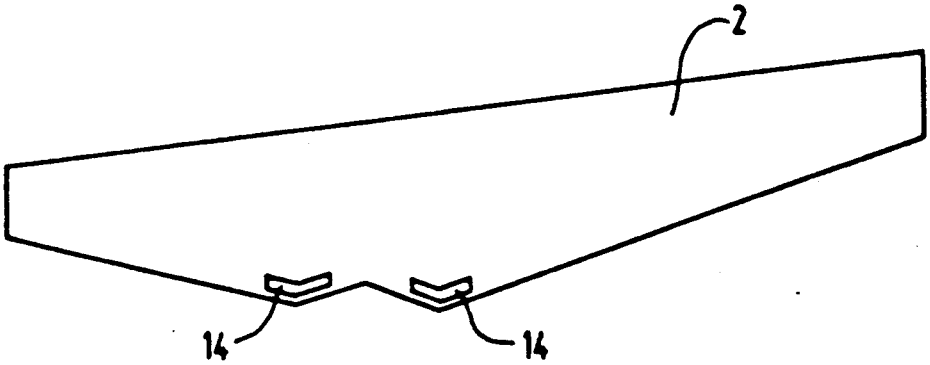
FIG. 2 is a diagrammatic side elevation view of a side wall formed with two blowing apertures usable in a device according to the present invention.
Figure 3:
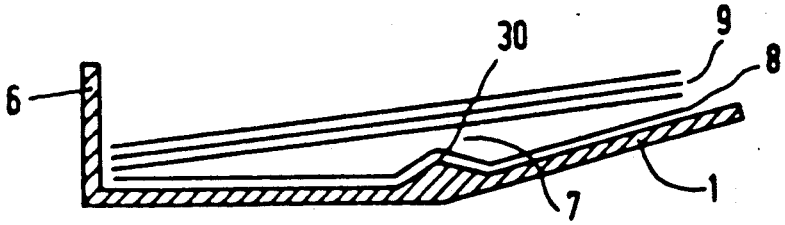
FIG. 3 is a diagrammatic side elevation view showing the lifting of the stack by means of a device according to FIG. 1.

In the embodiment of the side wall 2 shown in FIG. 2, the side wall is formed with two blowing apertures 14 on either side of the elevated part. As shown in FIG. 3, the blowing of air into the stack causes a layer of air 7 to form between the bottom sheet 8 sucked against the carrier in contact with the elevated part 30, and the remainder of the stack 9.

Figure 4:
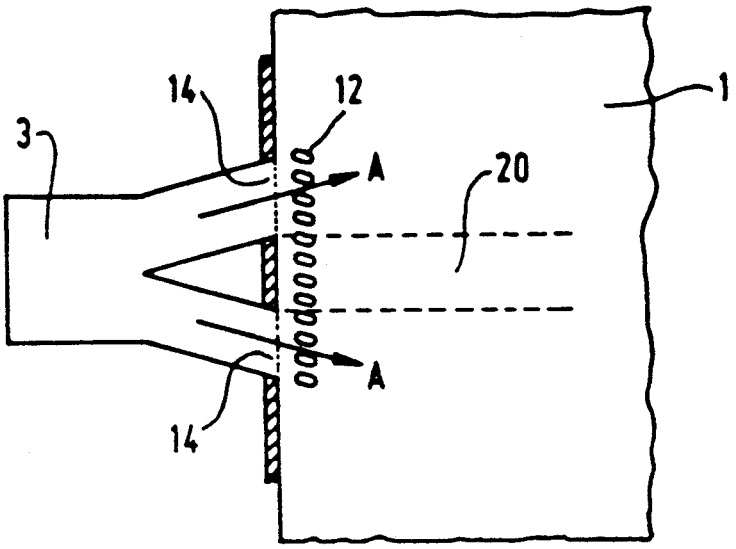
FIG. 4 is a diagrammatic cross-section in plan view of the blowing apertures showing the disposition of the blowing apertures in a further embodiment of the device according to the invention, FIGS. 5*a* to 5*d* each diagrammatically illustrate in side elevation alternate embodiments of the raised or elevated part of the carrier, FIGS. 6*a* to 6*c* each diagrammatically illustrate in cross-section taken along the line I—I of FIG. 1, other embodiments of the elevated part of the carrier, FIG. 7 diagrammatically illustrates in cross-section one embodiment of a blowing aperture, FIG. 8 diagrammatically illustrates in top plan view another embodiment of the carrier.
Figure 5A:
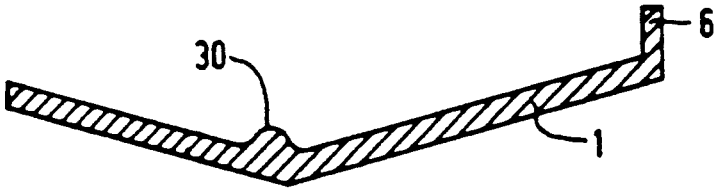
Figure 5B:
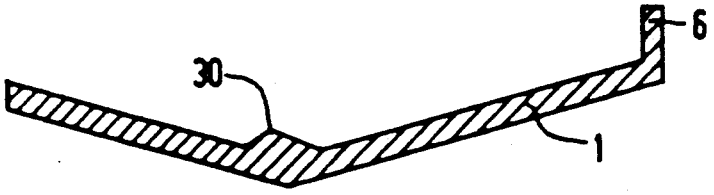
Figure 5C:
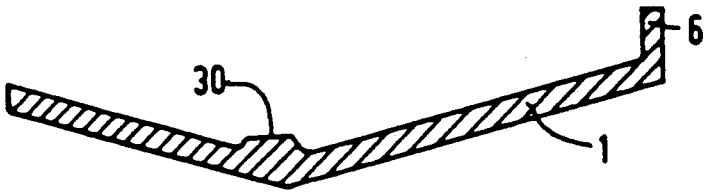
Figure 5D:
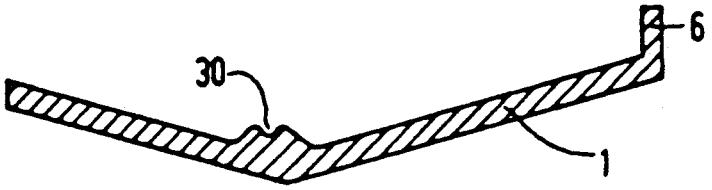

In a further embodiment of the device according to the present invention, as shown in FIG. 4, blowing apertures 14 ar arranged to be divergent with respect to one another from the air supply duct 3 on either side of the elevated part 20. In the vicinity of the elevated part and near the side walls the carrier is formed with a plurality of apertures 12 having the same function as the apertures 10 in the embodiment according to FIG. 1. The air is blown out in the directions A.

Figure 6A:
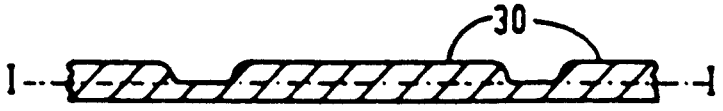
Figure 6B:
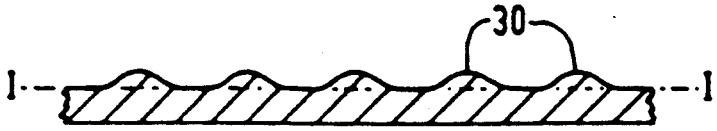
Figure 6C:
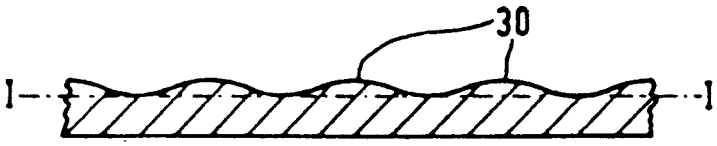

In alternative embodiments of the device according to the present invention, the elevated part 30 may be formed having different configurations. Some forms are shown in FIGS. 5*a* to 5*d*. It should be clear to the skilled artisan that a number of forms are useful in the device according to the instant invention and that the invention is not limited to the forms illustrated in the drawings. The elevated part may form an integral part of the carrier or be an addition secured thereto. The carrier may be formed in various ways. Some of the many possible forms are indicated in U.S. patent Ser. No. 499,945 filed Mar. 27, 1990. The deepened part of the carrier at the carrying side may be provided with one or more elevated parts which extend individually or jointly over the deepened part transversely of the direction of conveyance. A number of possible embodiments are illustrated diagrammatically in FIGS. 6*a* to 6*c* in cross-section taken along the line I—I of FIG. 1. It should be clear to the skilled artisan that many forms are suitable.

Figure 7:
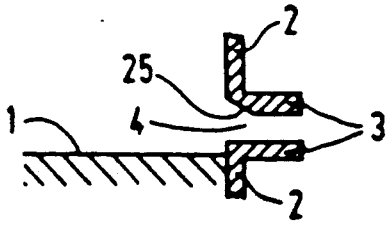

FIG. 7 shows a blowing aperture 4 in cross-section. An air supply duct 3 is connected to the side wall 2 formed with an aperture 4. The air is blown out of the aperture 4 across the carrier 1. The form of the aperture is such that the air blown out expands in the direction perpendicular to the carrier. To this end, the aperture 4 where it is contiguous with the side wall 2 is provided with a beveled corner 25 on the interior of side wall 2 extending gradually away from the carrier so that the blowing aperture is gradually widened in the upward direction. The same result can be achieved by fitting one or more small baffles in the vicinity of the blowing aperture.

Figure 8:
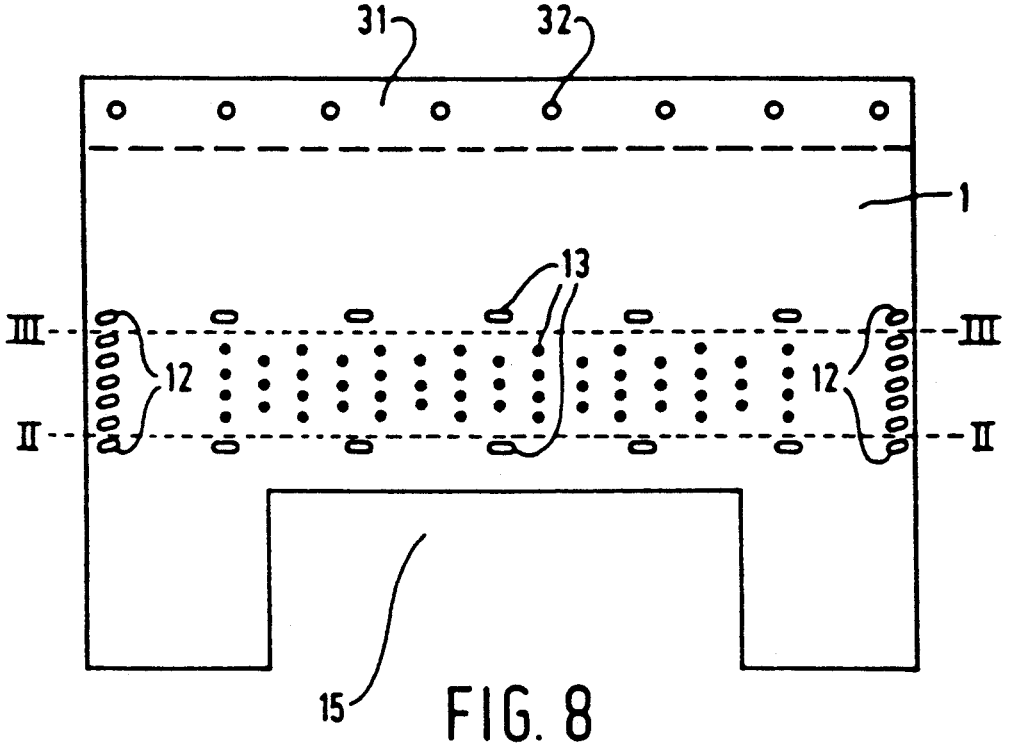

The embodiment of the carrier 1 shown in FIG. 8 extends in a deflected shape at the place indicated by line II—II, the angle between the front part of the plate and the rear part being 168°. The carrier has an elevated part 30 between the lines II—II and III—III. In this embodiment, the elevated part 30 is formed over its length with apertures 13 in which a partial vacuum can be produced. The apertures 13 may also be formed in the carrier in the vicinity of the elevated part as indicated. The front portion of the carrier 1 has a recess 15 formed therein for the transport means 16 (FIG. 1) used for discharging the bottom sheet. As considered in the direction of conveyance, the rear portion of the carrier also has an upwardly sloping part 31 formed with apertures 32 in which a partial vacuum can be produced. Sheets which are deformed at the rear edge, e.g. due to stapling or perforating, are thus separated from one another more easily at the place of deformation.

Figure 9A:
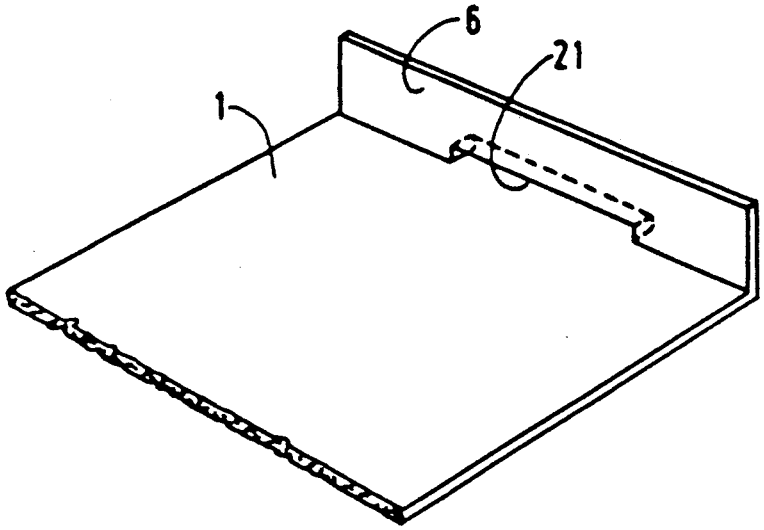
FIGS. 9*a* and 9*b* are respectively a diagrammatic perspective view and cross-section of one embodiment of a rear wall of a device according to the present invention.
Figure 9B:
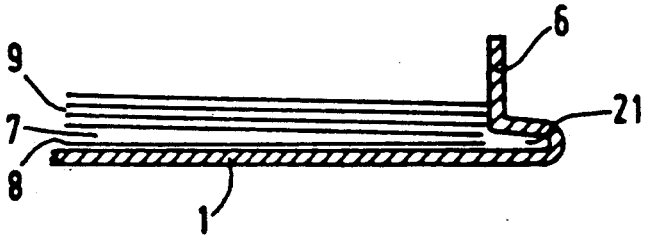

If sheets are to be separated and discharged from a stack of just a few sheets, the sheets will tend to creep up against a closed rear wall 6 of the holder, one without apertures, which renders separation and conveyance of the sheets unreliable. To eliminate this problem, in one embodiment the rear wall is provided with a cavity 21, as shown in FIGS. 9*a* and 9*b*. The air blown into a stack of just a few sheets can readily escape or be trapped via this cavity 21, thus obviating creeping of the sheets up against the rear wall. In the case of thicker stacks of curled sheets, the stack above the cavity 21 adjoins the rear wall so that a good layer of air can be built up between the bottom sheet and the sheets above. At the bottom of the rear wall the cavity 21 substantially adjoins the carrier 1 and its height, perpendicular to the carrier 1, is 3 cm at most. This is an optimum height for very curled sheets of paper of A4 size and a weight of 110 g/mz$^2$. For other materials having other weights and formats it may be advantageous to adjust the height.

In another embodiment of the device according to the present invention, the air flowing out of the rear side of the stack via the apertures 6*a* (FIG. 1) is conducted to the side of the stack via, for example, guides (not shown), in order to improve the lateral positioning of the stacked sheets The transport means 16, as shown in FIG. 1, comprises a movable endless rubberized belt 17 formed with apertures 20 in which a partial vacuum can be produced. The rubberized belt 17 runs about two rollers 18 and about a suction box (not shown) provided within the periphery of the belt 17 The suction box is connected to a vacuum device (not shown) by which a partial vacuum can be produced in the apertures 20. To enable the bottom sheet to be discharged, the belt 17 must exert a force on the bottom sheet such that the friction of the sheet with, on the one hand, the carrier 1 and, on the other hand, the sheet directly above the bottom sheet, are overcome. The force that the belt 17 exerts on the bottom sheet depends, inter alia, on the coefficient of friction between the belt 17 and the sheet to be transported, the partial vacuum in the suction box and the effective suction area. The effective suction area is the operative area where the partial vacuum is created and depends, inter alia, on the roughness of the belt 17 and of the sheet to be transported, on the size of the apertures 20, and the hole or aperture pattern in the belt 17 and on the size of the suction box beneath the belt 17. It may be advantageous to make the apertures 20 in the belt 17 wider on the side facing the sheets than on the opposite side, so that the effective suction area is increased while retaining the firmness of the belt. Instead of the transport means 16, other transport means known for this purpose may be used. Use may be made of a friction roller or a suction roller as disclosed in U.S. Pat. No. 4,579,330, but in view of its larger effective suction area the transport means 16, according to FIG. 1, is preferred.

The lateral supports need not consist of side walls extending along the entire side of the stack, as shown in FIGS. 1 and 2, but may, for example, be constructed as lateral abutments against a part of the stack or as locating pins, with one or more air supply ducts being disposed near the part where the carrier is the deepest, such ducts leading into blowing apertures directed toward the stack. It is not necessary for the lateral supports to directly adjoin the stack. The means for blowing air against the side of the stack may also be positioned just at one side. In order to avoid electrostatic charges as much as possible, the carrier may be made from an antistatic plastic or be provided with a conductive layer.

The device of the present invention can be used in an electrophotographic copying machine for repeatedly discharging a set of documents sheet-by-sheet to the exposure window of the machine, whereafter the sheets are copied and then re-deposited into the holder. In order to promote good positioning of sheets to be deposited on the stack and good separation, it is desirable for the holder to be so positioned, as considered in the direction of conveyance, that the front edge of the carrier 1 is higher than the rear edge. Furthermore, by making one or two of the lateral supports movable, it is possible within certain limits to use the device for discharging sheets of different sizes. The rear wall can also be made movable for this purpose.

The operation of the above-described device can be explained accordingly. By creating a partial vacuum in the various apertures in the carrier 1 and the transport belt 17 and by blowing air against the side of the stack in the vicinity of the deepened part of the carrier, the bottom sheet is sucked against the carrier and, since the front and rear sides of the stack operate as seals because of the dead-weight of the stack, a layer of air or an air chamber forms between the bottom sheet and the stack thereabove. The pressure exerted by the air in this layer of air causes the stack situated above the bottom sheet to be lifted therefrom so that the friction between the bottom sheet and the rest of the stack is reduced. Each elevated part extending over the carrier imparts a deformation to the bottom sheet under these conditions (FIG. 3), and because of its greater rigidity the stack situated thereabove is less likely to follow such deformation. By blowing air against the side at the deformation the stack is reliably separated from the sheet therebeneath. The size and shape of the space formed between the bottom sheet and the rest of the stack during the blowing operation is influenced, inter alia, by the shape of the carrier, the place where the air is blown in, the number of blowing apertures in the side walls, the shape of the blowing apertures, the direction in which the air is blown, the amount of air blown into the stack, the air velocity, and the presence of leakage apertures through which air can escape from the stack. Depending on the construction of the device, the skilled artisan can, by simple experimentation, arrive at the combination required between the air velocity, amount of air blown in, and blowing direction, to achieve good separation. At the instant that the air layer has formed between the bottom sheet and the stack thereabove, the bottom sheet is discharged through the agency of the transport means 16. Under these conditions it is particularly advantageous to pull the bottom sheet away from beneath the stack at high acceleration. The sheet situated directly above this bottom sheet then remains behind due to mass inertia. Good results can be obtained with an acceleration of about 30 $m/s^2$. If the deepened part of the carrier 1 situated in the vicinity of the elevated part 30, and/or the elevated part 30 is provided with apertures 13 transversely of the direction of conveyance, in which apertures a partial vacuum can be produced, as shown in FIG. 8, then when the bottom sheet has been pulled away from the apertures in or juxtapositioned to the elevated part, the air present between the sheet and the stack thereabove can be discharged so that the next sheet situated directly above the bottom sheet is rapidly conveyed to the carrier 1, whereafter the sheet is sucked against the carrier at the location of the apertures 1 in which there is a partial vacuum. The presence of such apertures 13 on a carrier having one or more elevated parts, as shown in FIGS. *6a–6c*, is advantageous. The sheet sucked towards the carrier then receives an extra deformation, transversely of the direction of conveyance, and this improves the separation between the bottom sheet and the stack thereabove.

After the bottom sheet has been discharged from the holder the drive to the transport means 16 is stopped. Some time is required before a new air layer forms between the next sheet sucked against the carrier and the stack and the next sheet can be transported. This time depends, inter alia, on the amount of air blown in, the air velocity and the rigidity of the sheets. It should be noted that the partial vacuum in the various apertures of the carrier, the partial vacuum in the suction box present within the periphery of the transport belt 17, and the air supply to the stack can be maintained during the discharge of the sheets one-by-one.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A holder for receiving sheets and discharging sheets therefrom one-by-one from the bottom of a stack of sheets which comprises a carrier having a rear portion, an intermediate portion and a front portion, together providing a carrier surface for said sheets, said carrier being bent at said intermediate portion thereof, transverse to a direction of conveyance of said sheets, so as to create a deepened section between said rear portion and said front portion, lateral supports extending from lateral edges of said carrier, at least one elevated part in said deepened section at said intermediate portion extending transverse to said direction of conveyance on said carrier surface of said carrier, at least one aperture provided in said carrier surface near at least one of said lateral supports juxtapositioned to said deepened section of said carrier and said elevated part, beneath at least one edge area at a side of said stack of sheets accommodated in said holder, such that a partial vacuum can be produced by way of said at least one aperture beneath said sheets using a vacuum means, means for introducing and blowing air across said deepened section of said carrier against at least one side of said stack of sheets whereby an air layer is created between at least the bottom sheet in said stack of sheets and the remaining sheets in said stack so as to substantially separate said bottom sheet from said remaining sheets in said stack of sheets and a transport means for discharging said bottom sheet.

2. A holder according to claim 1, wherein said elevated part comprises a rib extending over an entire width of said carrier surface, transverse to the direction of conveyance of the sheets.

3. A holder according to claim 1, wherein said means for blowing air against said at least one side of said stack of sheets comprises at least one blowing aperture through which air can be blown on either side of said elevated part.

4. A holder according to claim 3, wherein said blowing aperture comprises at least one pair of apertures in at least one of said lateral supports each aperture of said pair being disposed on either side of said elevated part in a divergent manner with respect to one another.

5. A holder according to claim 1, wherein said means for blowing air against said at least one side of said stack or sheets comprises at least one blowing aperture provided with a means for allowing air blown towards said stack of sheets to be expanded in a direction perpendicular to said carrier.

6. A holder according to claim 5, wherein said air expansive means of said air blowing means comprises a beveled upper edge of said air blowing means.

7. A holder according to claim 1, further including apertures across said sheet carrying surface of said carrier in said deepened part transverse to said direction of conveyance of said sheets situated either within said elevated part and/or juxtapositioned to said elevated part, such that a further partial vacuum can be produced by way of said additional apertures.

8. A holder according to claim 1, wherein said rear portion of said carrier is provided with an upwardly sloping part formed with apertures in which a partial vacuum can be produced.

9. A holder according to claim 1, further including a rear wall extending from a rear edge of said carrier.

10. A holder according to claim 9, when said rear wall is provided with a cavity in at least a portion of said rear wall juxtapositioned to said carrier.

11. The holder according to claim 10, wherein said cavity has a height of about 3 cm perpendicular to said carrier.

12. The holder according to claim 9, wherein said rear wall is provided with apertures therein.

13. The holder according to claim 1, wherein said elevated part is discontinuous in form across said intermediate portion of said carrier.

14. The holder according to claim 1, wherein at least one of said lateral supports is movable.

15. The holder according to claim 9, wherein said rear wall is movable.

* * * * *